US006308354B1

(12) United States Patent
Lilly et al.

(10) Patent No.: US 6,308,354 B1
(45) Date of Patent: Oct. 30, 2001

(54) UPHOLSTERY PAD WITH STEEL REINFORCED SUPPORT

(75) Inventors: Edward F. Lilly, St. Charles; Robert J. Sabalaskey, Carol Stream, both of IL (US)

(73) Assignee: Serta, Inc., Itasca, IL (US)

( * ) Notice: Subject to any disclaimer, the term of this patent is extended or adjusted under 35 U.S.C. 154(b) by 0 days.

(21) Appl. No.: 09/454,397

(22) Filed: Dec. 3, 1999

(51) Int. Cl.[7] ..... A47C 27/05; A47C 27/16

(52) U.S. Cl. ..... 5/721; 5/717; 5/701; 5/700; 5/727

(58) Field of Search ..... 5/721, 700, 717, 5/739, 690, 696, 701, 716, 718, 740, 727

(56) References Cited

U.S. PATENT DOCUMENTS

| | | | | |
|---|---|---|---|---|
| Re. 32,734 | * | 8/1988 | McLeod | 5/727 X |
| 1,884,270 | * | 10/1932 | Rylander | 5/721 |
| 2,133,762 | * | 10/1938 | Williams | 112/417 |
| 2,174,711 | | 10/1939 | Walker | 5/354 |
| 2,221,507 | * | 11/1940 | Clark | 5/721 X |
| 2,319,431 | | 5/1943 | Owen | 5/260 |
| 2,423,159 | * | 7/1947 | Shockey | 5/721 X |
| 2,430,612 | * | 11/1947 | Hever | 5/721 X |
| 2,471,125 | | 5/1949 | Sohn et al. | 5/351 |
| 2,543,218 | | 2/1951 | Young et al. | 5/351 |
| 2,567,330 | * | 9/1951 | Gagnier | 5/721 X |
| 2,576,455 | | 11/1951 | Gratt | 5/354 |
| 2,582,479 | * | 1/1952 | Clark | 5/721 X |
| 2,638,154 | * | 5/1953 | Dewees | 267/83 |
| 2,838,771 | | 6/1958 | Goodman et al. | 5/345 |
| 2,878,494 | | 3/1959 | Healy | 5/345 |
| 2,906,320 | * | 9/1959 | Reed | 5/721 X |
| 2,940,512 | * | 6/1960 | Reed | 5/721 X |
| 3,024,476 | * | 3/1962 | Reed | 5/721 X |
| 3,024,477 | * | 3/1962 | Reed | 5/721 X |
| 3,132,352 | * | 5/1964 | Doerer | 5/721 X |
| 3,132,353 | * | 5/1964 | Doerer | 5/721 X |
| 3,132,354 | * | 5/1964 | Doerer | 5/721 X |
| 3,132,355 | * | 5/1964 | Doerer | 5/721 X |
| 3,132,356 | * | 5/1964 | Doerer | 5/721 X |
| 3,315,283 | * | 4/1967 | Larsen | 5/721 X |
| 3,319,274 | | 5/1967 | Upton | 5/345 |
| 3,512,192 | * | 5/1970 | Simon | 5/740 X |
| 3,751,742 | | 8/1973 | Worley | 5/317 R |
| 4,083,069 | | 4/1978 | Glickman | 5/345 R |
| 4,106,142 | | 8/1978 | Schuder | 5/345 R |
| 4,463,466 | * | 8/1984 | May et al. | 5/721 |
| 4,476,594 | | 10/1984 | McLeod | 5/464 |
| 4,639,952 | * | 2/1987 | Kensinger | 5/13 |
| 5,287,572 | * | 2/1994 | Strobel | 5/727 X |
| 5,319,814 | | 6/1994 | Dyer, Jr. | 5/464 |
| 5,416,936 | | 5/1995 | Chan | 5/448 |
| 5,579,549 | | 12/1996 | Selman et al. | 5/721 |
| 5,704,085 | * | 1/1998 | Sabalaskey | 5/721 X |
| 6,101,653 | * | 8/2000 | England | 5/727 X |

* cited by examiner

*Primary Examiner*—Lynne H. Browne
*Assistant Examiner*—Robert G. Santos
(74) *Attorney, Agent, or Firm*—Gardner, Carton & Douglas

(57) ABSTRACT

A mattress is provided having an innerspring, at least one upholstery layer, which includes at least one foam layer, and quilt panel layers. The upholstery layer has an edged support layer, a steel wire grid laminated to the edged support layer, and a firm foam layer laminated to the steel wire grid. The steel wire grid serves to provide support and to reduce the sagging effect caused when adding additional foam layers. The firm foam layer provides support distributed even across the mattress and may be used alone or in combination with the steel wire grid.

10 Claims, 2 Drawing Sheets

UPHOLSTERY PAD WITH STEEL REINFORCED SUPPORT

BACKGROUND OF THE INVENTION

1. Field of the Invention

This invention relates to mattresses, in particular, to the upholstery pad of a mattress with reinforced wire grid support.

2. Scope of the Prior Art

A conventional mattress generally consists of an innerspring with at least one upholstery layer, and a quilt panel portion. Typically, both the upholstery portion and the quilt panel portion in a mattress are made of layers of foam and fiber. The foam and fiber products provide the level of support and comfort of a mattress, referred to as its "firmness." The firmness of a mattress is a function of the foam and fiber layers in both the upholstery portion and the quilt panel portion as well as the performance characteristics of the innerspring.

In general, the innerspring consists of border wires which form a rectangular structure that surrounds a plurality of interconnected coil springs situated in rows and columns within the rectangular structure of the innerspring. The performance of an innerspring is a function of coil count, coil density, coil shape, the number of turns of the coil, the wire gauge, the heat treatment of the wire, the assembling technique, and the edge treatment, among other factors. These characteristics of the innerspring should be taken into consideration when designing an innerspring.

The layers of foam and fiber that make up the upholstery portion are adjacent to the top and bottom surfaces of the innerspring. The upholstery portion generally consists of an insulating layer of material next to the innerspring and a layer of padding. The insulating layer satisfies two purposes: it masks or insulates the noise produced by the interaction between the coils of the innerspring, and it prevents the softer upholstery materials from falling into the pockets of the innerspring. The insulating layer may be constructed of a wire mesh, a plastic mesh, or woven or non-woven material. Adjacent to the insulating layer is a layer of padding material which affects the firmness of a mattress. This layer may be constructed of natural fibers, such as cotton, synthetic fibers, foam, or any combination of these. Additional layers of padding may also be provided in the upholstery portion, thereby increasing the comfort level and the quality of the mattress.

The outermost part of the mattress is the quilt panel portion which is adjacent to the top and bottom upholstery portions. The quilt panel portion comes in direct contact with the sleeper and thus provides the perception of softness or feel. The quilt panel portion typically consists of a layer of mesh or cloth backing material, a layer of foam material positioned over the backing material, a layer of fiber or filler material on top of the foam and finally, a ticking layer forming the cover of the mattress. The level of comfort provided by the mattress and the quality and expense of the mattress is a function of the number and characteristics of foam and filler layers in the quilt panel portion. The quilt panel portion is so-named because the layers are stitched together with thread to form a quilt pattern. This stitching holds the layers together and provides a composite structure to the quilt panel portion.

More recently, mattresses have been improved by the addition of a firmer edge of the mattress as described in U.S. Pat. No. 5,704,085. Past approaches for increasing the strength of the edge of the innerspring were ineffective when more and thicker layers of upholstery and quilt panel portions were added. The support about the outer edge of the mattress disclosed in the '085 patent reduced sagging effect of the mattress when a sleeper sits on the edge of the bed. This edge support also allowed for more and thicker upholstery layers. Therefore, the '085 patent addressed the problems of past approaches by providing an edge support in the upholstery of the mattress.

While the invention of the '085 patent addressed the problems with edge support in mattresses with thicker upholstery and quilt panel portions, the problems associated with diminished innerspring support with thicker upholstery remained. Additionally, the support described in the '085 patent on its own only provided a strong support at the edge of the mattress; the additional firmness was not felt throughout the expanse of the mattress. Thus, a mattress embodying only the improvement disclosed in the '085 patent created a pocket of softness within the central portion of the mattress. For sleepers who prefer a firm bed, that was not a desired result.

The firmness of a mattress is measured by its indentation force deflection (IFD). Typically the foam in a mattress is 20–40 IFD, which is considered relatively soft. Traditionally, foams with a greater IFD were not used, as such firmness in a mattress was generally not considered comfortable. As mattresses became thicker and softer, the support provided by a standard mattress declined as a result of sagging upholstery and quilt panel portions. Past approaches attempted to remedy this problem by, for example, incorporating an anti-sagging means into the upholstery. Those approaches proved unsuccessful. Until the present invention, nothing in the prior art suggested the use or claimed the benefits of a wire grid in the upholstery of a mattress. In U.S. Pat. No. 3,317,274 to Upton, for example, the sag-resistant insert was constructed of foam rubber slabs and an aluminum stiffening portion. That insert was placed between a mattress and a box spring. In other words, Upton teaches a separate component that is completely detached from the innerspring assembly. U.S. Pat. No. 3,751,742 to Worley, disclosed a mattress filler composed of resilient foam that can be added to a mattress that had lost its supporting characteristics through use. The purpose of the mattress filler was to re-establish the original comfort of a used mattress. Finally, U.S. Pat. No. 2,174,711 to Walker disclosed the use of steel bands in parallel relation between the padding. The invention of the '711 patent, however, did not remedy the problem of sagging; it simply provided a barrier against the helical springs. Moreover, nothing in the prior art suggested the use of firmer foam as a supporting means in the upholstery. Instead the prior art assumed that every sleeper preferred a softer upholstery in the mattress, and thus the industry typically used 20–40 IFD foam.

Thus, there is a need for additional support in the upholstery portion in thicker mattresses to compensate for the sagging and loss of support of the innerspring. There is a further need for a firm foam support in the upholstery portion to rectify the problem of a soft pocket within the central region of the mattress. Additionally, the structure provided for additional support should not require additional and separate components to be purchased by the end user.

SUMMARY OF THE INVENTION

The general objective of the present invention is to provide a new and improved mattress having a steel reinforced support in the upholstery portion. In providing this support, the mattress allows for thicker, better quality mattresses without compromising support.

Another objective of the present invention is to provide for increased firmness throughout the upholstery thereby eliminating the soft pockets present in a mattress with only an edge support.

A further objective of the invention is to provide a firm mattress for sleepers with a preference for a firm bed.

Another important object of the present invention is to provide a mattress with a supporting upholstery portion that does not require separate parts.

The present invention achieves these objectives by providing a mattress having a reinforced support upholstery portion. The mattress includes an innerspring, upholstery portion and quilt panel portions. Each upholstery portion includes at least one foam layer where the foam layer may be laminated with a manufactured grid made of wire or other suitable material. In the preferred embodiment of the present invention, the manufactured grid is made of plastic cords connected by steel wire. The foam layer may further have a reinforced edged support layer. The preferred embodiment of the present invention includes a combination of an edged support layer made of foam with a reinforced edge, a wire grid and a firm foam layer all laminated together. The firm foam layer and the reinforced edged support layer may be constructed of about 130–170 IFD foam whereas the softer inner foam, which is surrounded by the reinforced edged support layer, is made of 20–40 IFD. This firm foam layer, which is laminated with the edged support layer and steel reinforced support grid, functions to provide a firm support in the upholstery portion for thicker and better quality mattresses. Alternatively, the firm foam layer may be used alone.

The present invention thus addresses the problem of inadequate support in thicker mattresses without significantly increasing labor and manufacturing costs by laminating the components together.

DETAILED DESCRIPTION OF THE DRAWINGS

Figure 1:
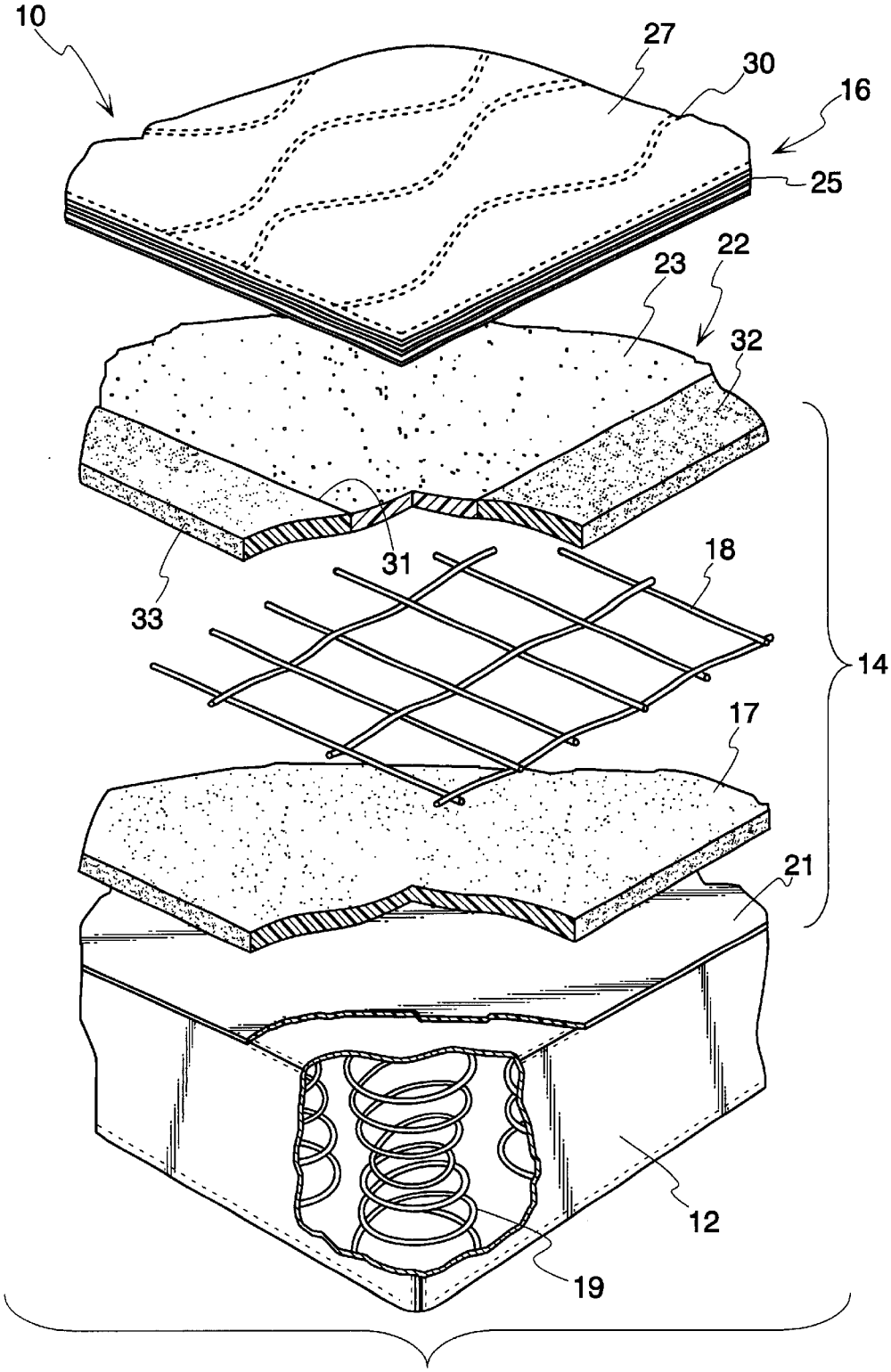
FIG. 1 is a cross-sectional view of a mattress made in accordance with the principles of the present invention.
Figure 2:
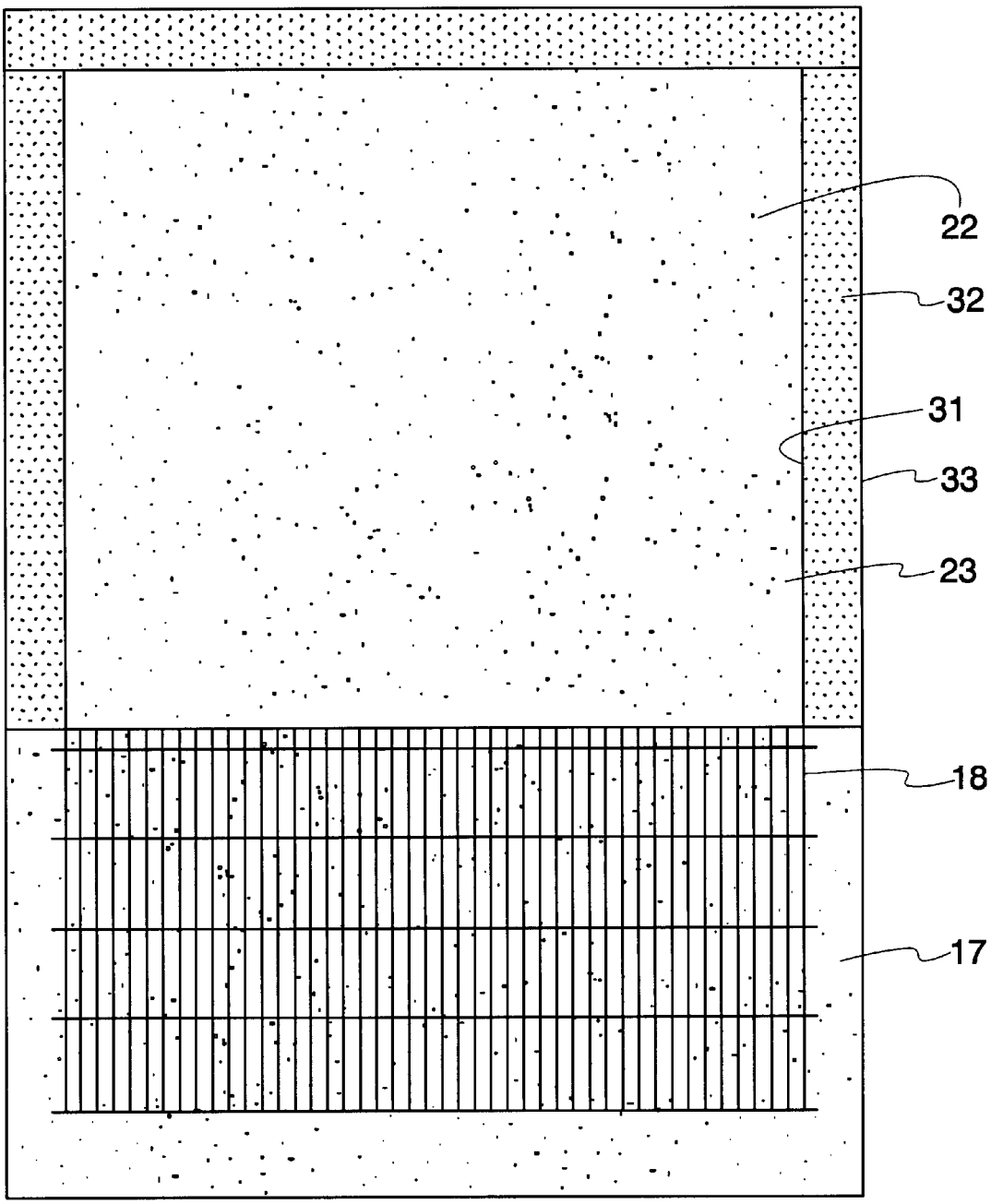
FIG. 2 is a top perspective view of the upholstery pad with steel reinforced support made in accordance with the principles of the present invention.

A mattress 10 made in accordance with the principles of the present invention is seen in FIGS. 1–2 and includes an innerspring 12, upholstery portion 14, and quilt panel portion 16. The upholstery portion 14 and the quilt panel portion 16 are shown in FIG. 1 above the innerspring 12 for the top surface of the mattress 10. It should be understood, however, that such an upholstery portion and quilt panel portion is also provided below the innersprings for the bottom surface of the mattress 10.

The innerspring 12 of the mattress 10 generally comprises border wires (not shown) forming a rectangular structure and, within the structure, a plurality of interconnected coil springs 19. The coil springs 19 are generally disposed in rows and columns over the entire area of the rectangular structure. The number of coils, their structure, and their arrangement depend upon the type of support to be provided and the size of the mattress. In the prior art, the structure of the innerspring 12 can take on many forms and is dependent upon many different factors, all of which can be used with the present invention.

The quilt panel portion 16 is made up of foam and/or fiber layers, collectively designated by numeral 25 with a covering of ticking 27. The components of the quilt panel portion 16 are stitched together with thread 30 to form a quilt pattern. The upholstery portion 14 is positioned between the innerspring 12 and the quilt panel portion 16. Each upholstery portion is constructed of multiple layers. Such layers include insulating layers 21 and firm foam layer 17 which are described in more detail below.

The present invention introduces the addition of a wire grid 18 and a firm foam layer 17 to the upholstery portion 14. The preferred embodiment of the present invention provides an upholstery portion 14 that includes at least an insulating layer 21, at least one firm foam layer 17, a wire grid 18 adjacent to and attached to the firm foam layer 17, and an edged support layer 22. The edged support 22 layer includes an outer edge portion 32 adjacent to and attached to the inner foam portion 23. This edged support layer 22 is adjacent to and can be attached to the wire grid 18. Of course, other layers can be used in the upholstery layer as desired to create the desired feel for the mattress.

The insulating layer 21 can be constructed of, for example, wire mesh, plastic mesh, woven fabric, or non-woven fabric. In the preferred embodiment, the insulating layer 21 is adjacent to the innerspring 12 and the firm foam layer 17.

The firm foam layer 17 is constructed of a material that will provide a firming effect, such as rebond foam, polystyrene foam, or more preferably, polyurethane foam. The firmness of the foam used for the firm foam layer 17 is in the range of approximately 130 to approximately 170 IFD, and preferably approximately 150 IFD. The foam in the firm foam layer 17 is in the range of approximately four to six times firmer than the foam used in the inner foam layer 23, which is described below as being between 20–40 IFD. The width and length of the firm foam layer 17 corresponds to the width and length of the mattress 10. Its thickness may vary from ⅜ inch to ½ inch. In the preferred embodiment, the thickness of the firm foam layer is approximately ⅜ inch. The firm foam layer 17 may extend over the entire expanse of the mattress. For a firm mattress, this firm foam layer 17 may be used above, and without any wire grid or edged support layer 22 in the upholstery portion. To achieve the same result as the firm foam layer 17 used above in the upholstery portion 14, the upholstery portion 14 can be configured in the mattress such that the firm foam layer is adjacent to the quilt panel portion 16.

Adjacent to the firm foam layer 17 is the wire grid 18. In the preferred embodiment the wire grid 18 is attached to the firm foam layer 17. Any means of attachment would suffice such as glue, heat bonding or adhesive solvents, though hot glue lamination is preferable. The wire grid 18 may be constructed of any flexible cord, preferably thin plastic cords connected by steel wire. In the preferred embodiment, the wire grid 18 is also adjacent and attached to the edged support layer 22 such that the wire grid 18 is positioned between the edged support layer 22 and the firm foam layer 17. Again, any means of attachment would suffice such as glue, heat bonding or adhesive solvents, though hot glue lamination is preferable. The wire grid 18 may extend to the outer edge of the edged support layer 22 or cover a portion of edged support layer 22 such that the outer edge of the grid extends beyond the inner foam portion 23 and onto the outer edge portion 32.

The edged support layer 22 comprises an outer edge portion 32 provided about the outer edge of the inner foam layer 23. The outer edge portion 32 is defined as having an inner perimeter 31 and outer perimeter 33. The outer edge portion 32 is of a former material than the inner foam layer 23 and is to be constructed of a material that will provide a firming effect. Examples of such material are rebond foam polyurethane foam fiber pad, and polystyrene foam. The foam used for the outer edge portion 32 is in the range of approximately 130 to approximately 170 IFD, and preferably approximately 150 IFD.

The inner foam portion 23 abuts the inner perimeter 31 of the outer edge portion 32. The foam used in the inner foam portion 23 varies from approximately 20 to approximately 40 IFD, and preferably approximately 30 IFD. Thus, the foam of the outer edge portion 32 is in the range of approximately four to six times firmer and preferably approximately five times firmer than the foam used in the inner foam layer 23. It should be noted that although FIGS. 1 and 2 depict the edge firming means to be provided to a foam layer made of flat foam it is within the scope of this invention that such edge firming means can be provided to a foam layer constructed of convoluted foam.

The outer edge portion 32 can be attached to the perimeter of the inner foam layer 23 by any suitable means, such as glue, heat bonding or adhesive solvents. In the preferred embodiment, the outer edge portion 32 is approximately 4 inches in width with a variable length corresponding to the size of the mattress 10 and is laminated to the inner foam portion 23 such as glue, heat bonding or adhesive solvents. Preferably the thickness of the outer edge portion 32 is constant with the thickness of the inner foam layer 23, preferably approximately ⅝ inch.

Other embodiments incorporating the principles of the present invention include using the firm foam layer 17 alone or only in combination with the wire grid 18. Alternatively, the firm foam layer 17 may be used only in combination with the edged support layer 22. In the preferred embodiment, however, the firm foam layer 17 is laminated to the wire grid 18, which is in turn laminated to the edged support layer 22 using any known laminating means such as hot glue. When these three components are laminated together, the resulting product may be inverted. Thus the use of the laminated upholstery portion of the present invention provides a mattress that may be geared toward any consumer preference, firm or soft. For example, if a sleeper prefers a firm mattress, the mattress is constructed with the firm foam layer 17 the most proximate to the sleeper and adjacent to the quilt panel portion 16. Yet when the sleeper prefers a softer mattress, the mattress is constructed with the edged support layer 22 closest to the sleeper and adjacent to the quilt panel portion 16. In the preferred embodiment, the firm foam layer 17, the wire grid 18, and the edged support layer 22 are laminated together as described herein such that the laminated layer can be inverted between the positions that provide for a firm mattress and a softer mattress.

It is worth noting that the edged support layer 22 and the firm foam layer 17 serve to increase the height and strength characteristics of the mattress 10 without reducing the softness of the mattress. However, the invention may be practiced by combining the edged support layer 22 with the wire grid 18 or combining the firm foam layer 17 with the wire grid 18. Similarly, the order of the foam layers in the upholstery portion is not essential to the invention.

Accordingly, while the invention has been described in connection with certain embodiments, it should be understood that it is not intended to limit the invention to these particular embodiments. To the contrary, it is intended to cover all alternatives, modifications and equivalents falling within the spirit and scope of the invention as defined by the appended claims.

What is claimed is:

1. A mattress, comprising:

a) an innerspring;

b) at least one upholstery portion adjacent to the innerspring, comprising:

(1) at least one edged support layer having an edge of foam attached to the perimeter of an inner foam layer, wherein the edge of foam is firmer than the foam in the inner foam layer;

(2) a wire grid adjacent and attached to the edged support layer;

(3) at least one firm foam layer provided adjacent and attached to the wire grid and wherein the foam of the firm foam layer is firmer than the foam of the inner foam layer; and c) at least one quilt panel portion adjacent to the upholstery portion.

2. The mattress according to claim 1 wherein the firm foam layer is laminated to the wire grid.

3. The mattress according to claim 1 wherein the foam of the firm foam layer is about four to about six times firmer than the foam of the inner foam layer.

4. The mattress according to claim 3 wherein the foam in the firm foam layer is about five times firmer than the foam of the inner foam layer.

5. The mattress according to claim 1 wherein the foam in the firm foam layer is of the same firmness as the foam in the edged support layer.

6. The mattress according to claim 3 wherein the foam in the firm foam layer is about 130 to about 170 IFD.

7. The mattress according to claim 6 wherein the foam in the firm foam layer is about 150 IFD.

8. The mattress according to claim 1 wherein the upholstery layer is at least a one inch thick.

9. A mattress, comprising:

a) an innerspring;

b) at least one upholstery layer adjacent to the innerspring, said upholstery layer comprising:

(1) at least one edged support layer having an edge of foam attached to the perimeter of an inner foam layer, wherein the edge of foam is firmer than the foam in the inner foam layer;

(2) a wire grid adjacent and attached to the edged support layer wherein the wire grid is made of thin plastic cords connected by wire;

(3) at least one firm foam layer adjacent and attached to the edged support layer wherein the foam of the firm foam layer is about 130 to about 170 IFD; and c) at least one quilt panel layer adjacent to the at least one upholstery layer.

10. The mattress according to claim 1 wherein the edged support layer is laminated to the wire grid and wherein the wire grid is laminated to the firm foam layer.

* * * * *